United States Patent [19]

Wang

[11] Patent Number: 4,490,649

[45] Date of Patent: Dec. 25, 1984

[54] THERMAL BAFFLE INSIDE A DISCHARGE LAMP

[75] Inventor: Hsin-Pang Wang, Scotia, N.Y.

[73] Assignee: General Electric Company, Schenectady, N.Y.

[21] Appl. No.: 435,520

[22] Filed: Oct. 20, 1982

[51] Int. Cl.[3] ..... H01J 7/44; H01J 13/46; H01J 19/78; H01J 29/96

[52] U.S. Cl. ..... 315/50; 313/33; 313/609; 315/56; 315/65

[58] Field of Search ..... 315/49, 50, 65, 56; 313/33, 626, 580, 609, 610

[56] References Cited

U.S. PATENT DOCUMENTS

| | | | |
|---|---|---|---|
| 2,171,580 | 9/1939 | Macksoud | 315/49 |
| 3,400,288 | 9/1968 | Groth | 313/47 |
| 4,273,098 | 6/1981 | Silverstein | 126/417 |

FOREIGN PATENT DOCUMENTS

| | | | |
|---|---|---|---|
| 404101 | 1/1934 | United Kingdom | 315/49 |

*Primary Examiner*—Saxfield Chatmon

*Attorney, Agent, or Firm*—Donald R. Campbell; James C. Davis, Jr.; Paul R. Webb, II

[57] ABSTRACT

The ballast temperature in the base up position of a miniature arc discharge lamp is reduced, increasing its lifetime, by placing a thin transparent thermal convection/radiation baffle between the arc tube and lamp filament, which are the heat source, and the interface of the envelope with the ballast housing. Greater temperature reduction is realized by putting insulation inside the housing cover and reducing the diameter of wires supporting the arc tube and filament, the latter a ballast resistor.

4 Claims, 3 Drawing Figures

26
28
25
29
30
31
27
32
15
24
21
22
12
16
10
14
13
19
17
11
20
18

THERMAL BAFFLE INSIDE A DISCHARGE LAMP

BACKGROUND OF THE INVENTION

This invention relates to electric discharge lamps that have an integral ballast, and more particularly to lowering the ballast temperature of a universal position lamp.

The mass-produced incandescent lamp is relatively inexpensive but is inefficient, and the increasing cost of electrical energy has led to a re-evaluation of them relative to other types of long life, high efficiency lamps. If the cost of operating incandescent lamps is considered, along with their relatively short lifetimes, incandescent lamps may be uneconomical in certain situations. A number of different kinds of lamps have been suggested to fill the need for an efficient and long lasting lamp.

One candidate to replace the incandescent bulb is the HALARC® lamp from the General Electric Company, Cleveland, Ohio, one configuration of which is illustrated. The light output is provided mainly by the visible electromagnetic radiation in the miniature arc tube; an electronic ballast in the lamp itself limits the current and supplies starting and running voltage. The first generation of the HALARC lamp is designed only for base down usage. The natural convection inside the glass envelope containing the arc tube does not flow toward the ballast housing, and therefore the temperature of the electronic board is not excessive and it is under normal operating condition. In the base up position of the lamp, the ballast temperature is far beyond the limit of operating temperature of a reliable electronic system.

The second generation HALARC lamp is a universal position bulb installed either base down or base up. One of the most critical problems is the excessive ballast temperature in the base up mounting. According to ballast designers, every 10° C. decrease of the ballast temperature will double its lifetime. An economical thermal improvement concept which can significantly reduce the temperature of the electronics package will impact development of the universal position miniature arc lamp.

SUMMARY OF THE INVENTION

The heat transfer mechanism inside the envelope of an energy efficient discharge lamp for base down and base up operation is mainly due to the natural convection and thermal radiation. Such a lamp has a source of visible or ultraviolet radiation comprised of an arc tube, a visible light-transmissive envelope that encloses the arc tube and contains a gas, and an electronic ballast in a housing which is in good thermal contact with a portion of the envelope. A thermal convection/radiation baffle is placed inside the envelope between the heat source, the arc tube, and the ballast housing to significantly reduce the ballast temperature especially in base up operation of the lamp. The baffle is typically a thin transparent wafer that extends preferably from wall to wall of the envelope and has an infrared-reflecting coating on one surface which is transmissive to visible light.

The specific embodiment has a ballast resistor in the form of a lamp filament located inside the envelope; the filament is a heat source. The thermal baffle is close to the arc tube, between it and the filament and the envelope/ballast housing interface. The baffle increases both the thermal resistance of convection and the thermal resistance of radiation. Combined with the complementary changes, namely placing thermal insulation in the housing near the interface with the envelope and reducing the diameter of the wires supporting the arc tube and filament, the ballast temperature is reduced to acceptable levels.

DETAILED DESCRIPTION OF THE INVENTION

Figure 1:
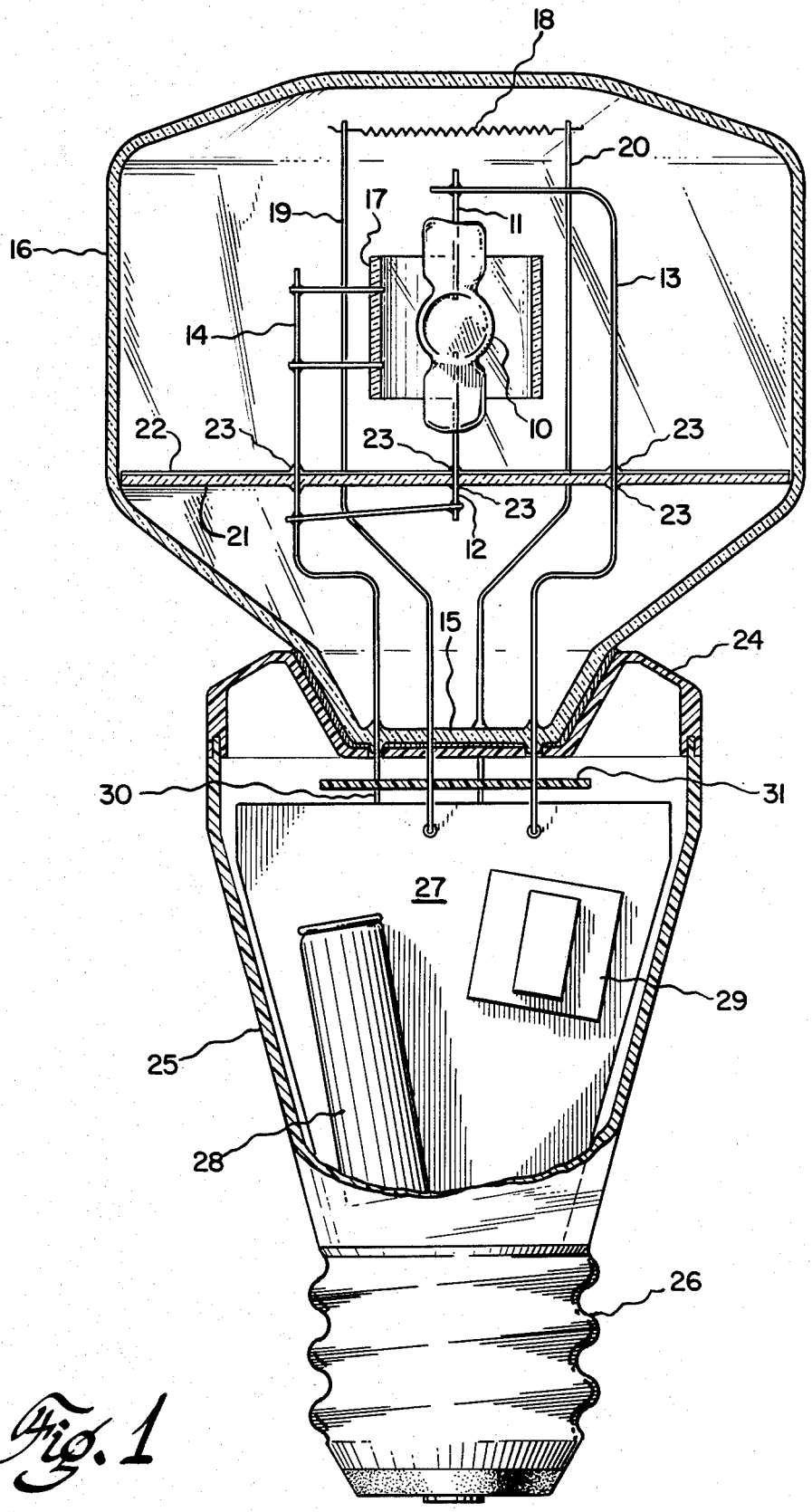
FIG. 1 is a vertical cross section and side view of the improved miniature arc discharge lamp which has a thermal convection/radiation baffle to lower the ballast temperature.

In FIG. 1, one embodiment of the efficient and long lasting, universal position discharge lamp has a source of visible radiation comprised of a miniature arc tube 10 having opposing electrodes 11 and 12 that is filled with a rare gas such as argon and contains mercury and metal halides. This is a small but otherwise conventional metal halide arc tube. Support wires 13 and 14 are mounted in and pass through the base 15 of the gas-tight envelope 16; the electrodes are fastened to these wires which provide mechanical support and electrical connection to the arc tube. A cylindrical glass shield 17, transmissive to visible light, partially surrounds the miniature arc tube 10 and is held in place by wires secured to one of the arc tube support wires. Glass envelope 16 is transmissive to the visible light output of the arc tube and contains gases like those in conventional incandescent bulbs, such as nitrogen with argon or another rare gas. This mixture of gases supports natural convection. A conventional tungsten lamp filament 18 is also inside the envelope, suspended between two support wires 19 and 20 so as to be at one side of but above arc tube 10 in the base down position of the lamp. The filament support wires pass through base 15 of the envelope and are the electrical connections. Lamp filament 18 serves as a ballast resistor and its visible light output is very small.

Reduction of the natural convection effect inside the envelope was found to be the key to solving the high temperature ballast problem in the base up position of the universal lamp. A thermal convection/radiation baffle 21 is placed inside the envelope 16 between the heat source, arc tube 10 and tungsten filament 18, and the interface between the envelope and ballast housing. The round baffle is of glass or Pyrex® or another material that is transparent to visible wavelengths and withstands the high temperatures. Preferably there is a thin infrared-reflecting coating 22 on one surface of the baffle disk; this is more effective since it reflects the thermal radiation without blocking the visible light transmission. The IR-reflecting film is, for instance, indium oxide doped with tin, $In_2O_3$:Sn, or tin oxide doped with fluorine, $SnO_2$:F, or another material known to those skilled in the lamp and solar collector arts. The prior art patents and publications may be referred to for information on the selection and fabrication of such films. The glass baffle 21 with an IR coating 22 on its surface is continuous, except for holes for the support wires, and extends from side wall to side wall of the envelope. It is as close as possible to the end of miniature arc tube 10 and is mounted on the envelope's side walls or retained in place by bumps or proturberances 23 on the support wires, only a few of which are shown in the drawing. One alternative is that shield 17 is enlarged and closed at the bottom by a baffle disk, resulting in a cup-shaped combination component.

The base 15 of the envelope is bonded with "RTV" silicone rubber to a plastic ballast housing cover 24, and thus the envelope and cover are in good thermal contact. The cover is provided with holes for the arc tube and filament support wires. The other components of the electronic ballast, less the ballast resistor, are inside the plastic ballast housing 25 to which is attached a conventional metal screw-in Edison base 26. A vertical alumina circuit board 27, a capacitor 28, and a transformer 29 are illustrated. Wires 30 are soldered to the electronic board and pass through a griplet board 31 and hence connect to the support wires in the envelope. The electronic ballast having a tungsten filament serving as a ballast resistor is described in copending application Ser. No. 401,506, filed July 26, 1982, V. D. Roberts, "Resistive Lamp Ballast with Reignition Circuit". The invention is not limited to this particular ballast, however.

Figure 2:
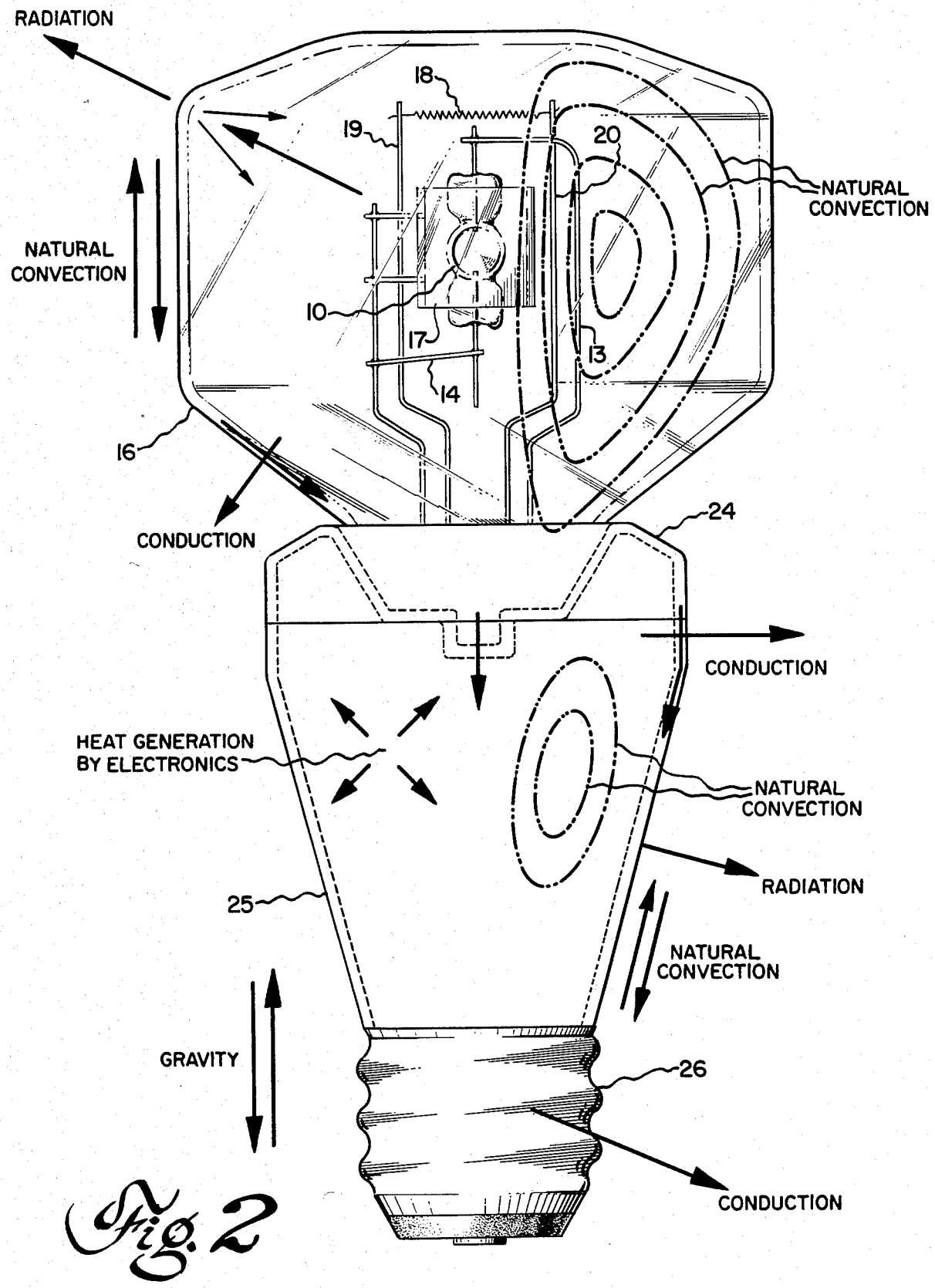
FIG. 2 is a side view of such a lamp without the baffle and shows the thermal transport in the lamp.

FIG. 2 shows the miniature arc discharge lamp without the baffle 21 which reduces the ballast temperature, and depicts the thermal transport in the lamp. The three basic heat transfer mechanisms are convection, conduction, and radiation. Natural convection is also known as the chimney effect and is defined as convection in which fluid motion results entirely from the presence of a hot body in the fluid, causing temperature and hence density gradients to develop so that the fluid moves under the influence of gravity. Natural convection inside envelope 16 has a circular pattern as illustrated. In the base up operating condition, the arc tube 10 and tungsten filament 18 have a relatively high temperature compared to that of the ballast housing (say, 900° C. vs. 200° C.) and initial fluid motion is in the vertical direction from the heat sources upwardly toward the ballast housing. The density of the gas changes and motion is then sidewards and downward inside the envelope. Thermal and infrared radiation from the arc tube and filament radiates outwardly toward the envelope and is lost to the ambient; a small percentage is reflected back. There is heat conduction in the glass envelope 16 and some heat is conducted from the inner to the outer surface and is released to the atmosphere. There are about 3 watts of heat transferred through the interface between the envelope and ballast housing. In the ballast housing 25, heat is generated in all directions by the electronics. There is a small amount of natural convection in an elongated circular pattern, but the temperature differences are much smaller in the housing 25 than in the envelope 16 (say, 200° C. at housing cover 24 and 100° C. at base 26). Heat is released to the ambient by radiation and natural convection from housing 25 and by conduction through the housing and metal base 26, and there is some conduction of heat by the plastic housing.

Based on the mechanisms of heat transfer and gas flow, the global energy balance was analyzed mathematically by several methods, namely the finite element method, thermal radiation network, and energy balance. It was found that the major driving force of the heat flux toward the ballast comes from the natural convection. Computer calculations showed that for the tungsten filament, 12 watts of energy are transferrred, 4 watts by convection and conduction, and 8 watts by thermal radiation. For arc tube 10, the total energy source is 23 watts of which 5.5 watts is visible light. It was found that 5 watts are transferred by convection and conduction and 12.5 watts by thermal radiation. The total energy transported from the glass envelope 16 to the ambient is 26.5 watts, 10 watts by convection and conduction and 16.5 watts by radiation. The total heat flux toward the ballast housing cover 24 is then 3 watts, 2.5 watts by convection and conduction and 0.5 watts by radiation.

The major difference in the heat transfer between the base down only miniature arc discharge lamp and the universal position lamp is the natural convection effect, since the radiation and conduction are independent of gravity force. Reduction of the natural convection effect is the key to solving the high temperature ballast problem. For good reliability, the ballast temperature should be less than 125° C., and above this temperature the reliability drops.

The natural convection is a function of the ratio of the temperature difference to the vertical distance ($\Delta T/L$) and the fluid properties. Experimental data shows that the temperature drop from the arc tube (900° C.) to the envelope/housing interface (200° C.) is 700° C. and the temperature drop inside the housing is less than 100° C. The driving force of natural convection is mainly due to the temperature difference. The thermal resistance between the arc tube 10 and envelope/housing interface is much bigger than the thermal resistance at the ballast housing. Therefore any change in thermal resistance inside the envelope 16 will have a dominant effect on the temperature reduction at the electronics board 27 inside the ballast housing. Inserting the convection/radiation baffle 21 near the end of the arc tube 10, inside envelope 16, approximately doubles the thermal resistance of the convection. The baffle by itself also increases the thermal resistance of radiation. Placing a transparent baffle with the IR coating 22 on the surface is certainly more effective, since it reflects the thermal radiation without blocking the visible light transmission. A baffle 21 with IR coating 22 significantly reduces the temperature of the electronics board 27, from 154° C. to 138° C. by one calculation.

Figure 3:
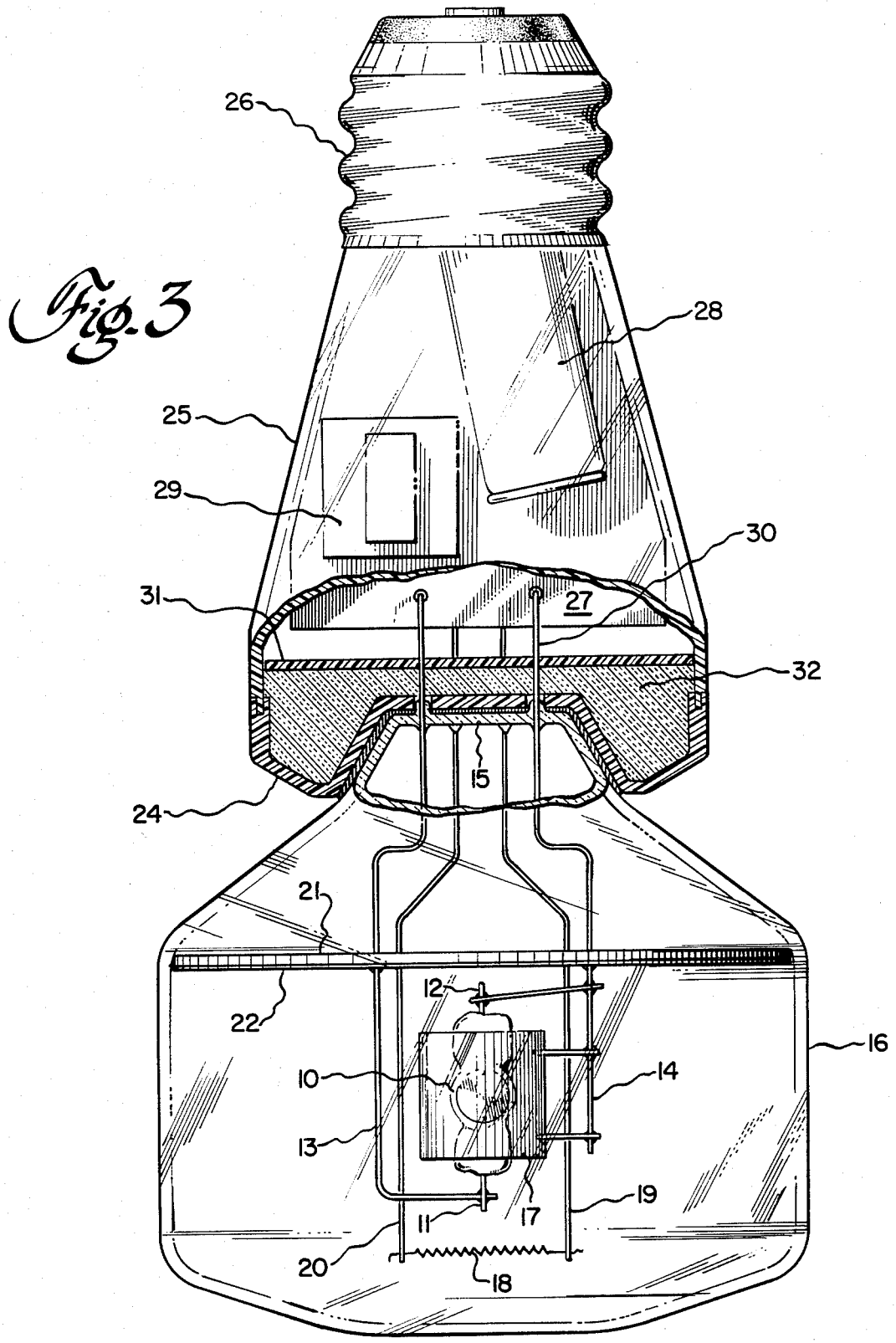
FIG. 3 illustrates, in the base up position, another embodiment having a baffle with IR coating plus insulation between the ballast housing cover and griplet board and reduced support wire diameters to realize a greater temperature reduction.

The ballast temperature is further decreased to acceptable levels by combining the thermal baffle having an IR coating with complementary lamp configuration changes. Referring to FIG. 3, thermal insulation 32 is placed in the ballast housing close to the interface with envelope 16 to reduce the heat flux from the envelope to the housing. Fiberglass or other insulation material is placed between the housing cover 24 and griplet board 31. Another design change to effect a reduction in the ballast temperature is to reduce the diameter of the various support wires, including arc tube and filament support wires 13, 14, 19, and 20. The smaller diameter wire conducts less heat into the ballast housing. These two changes, placing insulation material and wire diameter reduction, have been shown to result in an additional few degrees of ballast temperature lowering.

The thermal baffle and the foregoing and other measures to bring the ballast temperature down to about 125° C. may be employed individually and in any combination to other types of miniature arc discharge lamps. These include three copending applications of P. D. Johnson: Ser. No. 288,822, filed July 31, 1981, which has a fluorescent lamp comprising a small arc tube in which copper, produced by vaporization of copper halide, radiates in the near-ultraviolet region to excite phosphor on an outer jacket; Ser. No. 332,710, filed Dec. 21, 1981, now allowed, disclosing a fluorescent lamp comprising a source of near-ultraviolet radiation together with an outer shell of ultraviolet transmissive material that has embedded or dissolved therein a phosphor material; and Ser. No. 353,279, filed Mar. 1, 1982, now abandoned, describing a fluorescent lamp comprising a small arc tube, light being produced not only by an arc discharge but by phosphors on the envelope. All of the applications are assigned to the same assignee as this invention.

While the invention has been particularly shown and described with reference to several preferred embodiments thereof, it will be understood by those skilled in the art that various changes in form and details may be made therein without departing from the spirit and scope of the invention.

The invention claimed is:

1. A universal position electric discharge lamp comprising:

a source of visible radiation comprising an arc tube having electrodes therein;

a light-transmissive envelope that encloses said radiation source and contains a gas supporting natural convection;

an electronic ballast inside of a housing which is in good thermal contact with a portion of said envelope;

means for supporting said arc tube and making electrical connection to said electrodes; and thermal convection/radiation baffle means inside said envelope between said arc tube, which is a source of heat, and said ballast housing to reduce the ballast temperature and prolong the lifetime of said lamp;

said baffle means including a continuous transparent glass wafer which extends from side wall to side wall of said envelope and has an infrared-reflecting coating that is transmissive to visible light.

2. The lamp of claim 1 having thermal insulation in said ballast housing to reduce the heat flux from said envelope to said housing.

3. A universal position electric discharge lamp comprising:

a source of visible radiation comprising an arc tube having electrodes therein;

a light-transmissive envelope that encloses said radiation source and contains a gas supporting natural convection;

an electronic ballast comprised of a ballast resistor in the form of a lamp filament inside of said envelope, the remainder of said ballast being inside of a housing which is in good thermal contact with a portion of said envelope and to which is attached a base;

means for supporting said arc tube and lamp filament and making electrical connection thereto; and a thermal convection/radiation baffle with an infrared-reflecting coating on one surface, mounted inside said envelope between said arc tube and lamp filament, which are the heat source, and said ballast housing to increase the thermal resistance of convection and radiation and consequently reduce the ballast temperature in the base up operating condition;

wherein said baffle is a thin continuous glass disk that extends from side wall to side wall of said envelope and said disk and infrared-reflecting coating are transmissive to visible light.

4. The lamp of claim 3 which has thermal insulation in said ballast housing close to the interface with said envelope to reduce the heat flux from said envelope to said housing.

* * * * *